US007301854B2

(12) United States Patent
Ruefenacht

(10) Patent No.: US 7,301,854 B2
(45) Date of Patent: Nov. 27, 2007

(54) ANNUAL CALENDAR MECHANISM FOR TIMEPIECE

(75) Inventor: Christian Ruefenacht, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 163 days.

(21) Appl. No.: 11/261,919

(22) Filed: Oct. 31, 2005

(65) Prior Publication Data

US 2006/0120219 A1 Jun. 8, 2006

(30) Foreign Application Priority Data

Dec. 2, 2004 (EP) ..... 04028561

(51) Int. Cl.
*G04B 19/20* (2006.01)
*G04B 19/24* (2006.01)

(52) U.S. Cl. ..... 368/37; 368/28; 368/77; 368/221

(58) Field of Classification Search ..... 368/28, 368/35, 37, 77, 221, 220, 233
See application file for complete search history.

(56) References Cited

U.S. PATENT DOCUMENTS 5,432,759 A * 7/1995 Vaucher ..... 368/28

FOREIGN PATENT DOCUMENTS

| | | | |
|---|---|---|---|
| CH | 684 815 | A3 | 1/1995 |
| EP | 999 482 | A2 | 5/2000 |
| EP | 1 251 412 | A1 | 10/2002 |

* cited by examiner

*Primary Examiner*—Vit Miska
*Assistant Examiner*—Jeanne-Marguerite Goodwin
(74) *Attorney, Agent, or Firm*—Sughrue Mion Pllc.

(57) ABSTRACT

The annual calendar mechanism comprises a drive wheel set (1) fitted with a first finger (2) driving a date disc (4) through one step once a day and a second finger (5) driving a plate (6) secured to an annual wheel (7) arranged coaxially to the date ring at the end of the months of less than thirty one days. An intermediate wheel (8) connects the annual wheel (7) to the date ring (4) at the end of each month. The annual wheel (7) comprises twice as many teeth (30) as there are months in a year and the intermediate wheel (8) comprises a first wheel (40) meshed with the annual wheel (7) and a second wheel (50) fixed to the first wheel, said second wheel being meshed, at the end of each month, with a snug (60) arranged inside the date ring (4).

5 Claims, 6 Drawing Sheets

ANNUAL CALENDAR MECHANISM FOR TIMEPIECE

The present invention relates to an annual date mechanism for a timepiece comprising a date drive wheel set completing one revolution in twenty four hours, this wheel set being fitted with a first finger driving, through one step once a day, a first stage of a date ring comprising thirty one inner teeth, said wheel set being fitted with a second finger driving through one step and at the end of a month of less than thirty one days, one of the five snugs of a plate secured to an annual wheel arranged coaxially to the date ring, said mechanism further comprising an intermediate wheel connecting, at the end of each month, said annual wheel to a second stage of said date ring.

Elements contained in the above definition are known from the Patent documents EP-A-1 251 412 and CH-B-684 815. A date drive wheel set completing one revolution in twenty-four hours is also found in these documents. In both documents, the drive wheel set is fitted with a first finger driving a date display through one step once a day and a second finger driving one of the five snugs fitted to a plate secured to an annual wheel through one step at the end of a month of less than thirty one days. An intermediate wheel, which connects the annual wheel to the date display at the end of each month, is also found in these documents.

More specifically, Patent No. EP-A-1 251 412 implements a ring with two stages carrying the date display and an annual wheel arranged coaxially to said ring. A first finger of the drive wheel set meshes with the thirty one inner teeth of a first stage of the ring, a second finger located at the end of a month of less than thirty one days on the path of a plate with five snugs on which there is fixed an annual ring comprising seventeen teeth. This annual ring meshes with an intermediate wheel that also comprises seventeen teeth, seven of which are thinned. The second stage of the ring carries two inner teeth, one of the teeth being thinner than the other. The assembly is arranged in such a way that at the end of the months of thirty-one days the annual ring moves forward one step and at the end of the months of less than thirty-one days, said wheel moves forwards two steps. Consequently, the month indicator comprises seventeen equal sectors. The name of the months with thirty one days (January, March, May, July, August, October, December) appear once and the name of the days with less than thirty one days (February, April, June, September, November) appear twice through an aperture cut into the timepiece dial.

The mechanism that has just been described has the drawback of a hybrid monthly indicator, the months with thirty-one days only appearing once through the aperture whereas the months with less than thirty-one days appear twice. Moreover, this mechanism requires the use of a relatively complex intermediate wheel since of the seventeen teeth that it has, ten are thick and seven are thinned, which involves particular complex machining of the intermediate wheel. This mechanism also requires the presence, on the second stage of the ring, of two snugs located at different levels, which complicates the manufacture of the stage. Finally, it should be mentioned that, when the mechanism is assembled, the intermediate wheel has to be placed in a very precise angular position to ensure proper synchronisation of the date display and corresponding month display.

CH Patent No. B-684815 implements more particularly an annual calendar wherein the date display is a hand. In this embodiment, the annual wheel is not central, but offset towards the top of the timepiece. This results in a complex mechanism, the name of the months appearing on an off-centre disc meshed with an intermediate wheel comprising thirty-one teeth, thirty of which are truncated.

In order to avoid the drawbacks of the aforecited documents, in addition to satisfying the generic definition expressed in the first paragraph of this description, the present invention is characterized in that the annual wheel comprises two times more teeth than number of months in a year and in that the intermediate wheel comprises a first wheel meshed with the annual wheel and a second wheel securely fixed onto and arranged coaxially to the first wheel, said second wheel being meshed, at the end of each month, with a snug arranged inside the second stage of the date ring.

The features and advantages of the present invention will appear in the following description, made with reference to the annexed drawings and giving, by way of explanatory but non-limiting example, two advantageous embodiments of an annual calendar, and in said drawings.

Figure 1:
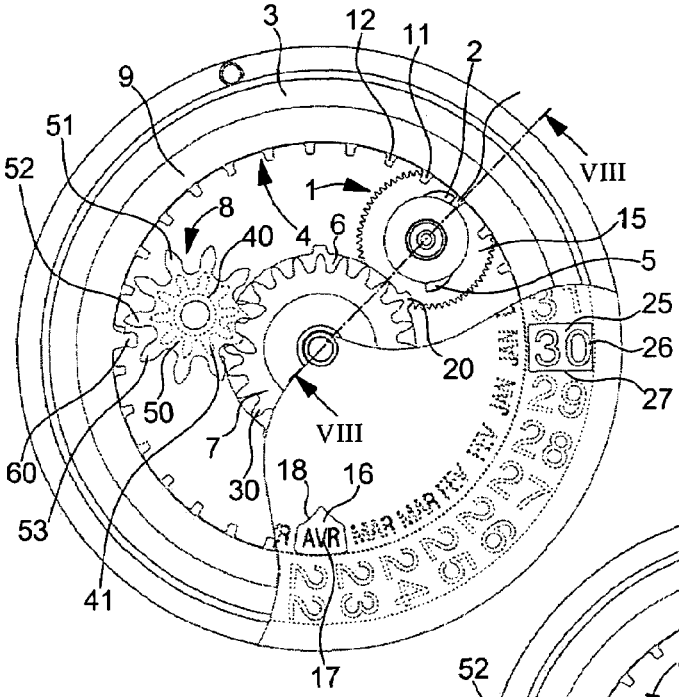
FIG. 1 is a plan view of the annual calendar mechanism as it appears on 30th April at 23:30 in accordance with a first embodiment of the invention.
Figure 2:
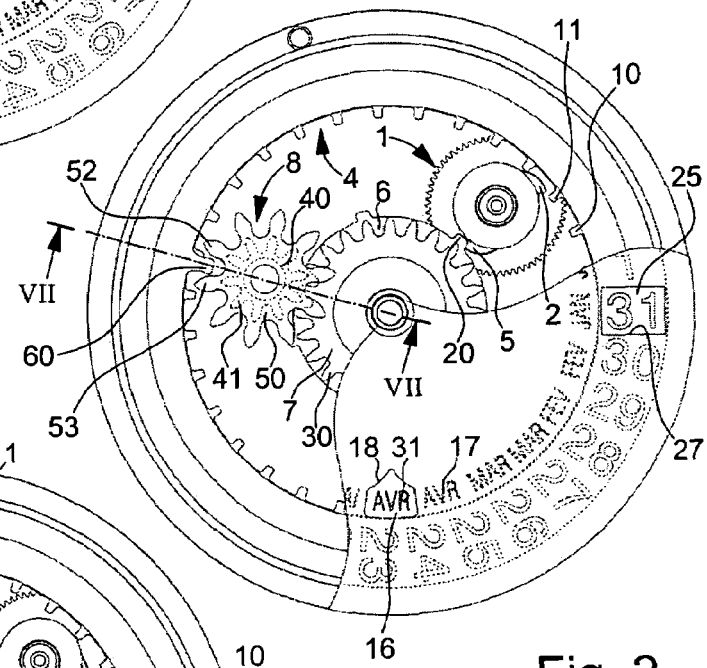
FIG. 2 illustrates the same mechanism as that shown in FIG. 1 on 1st May at 00:30.
Figure 3:
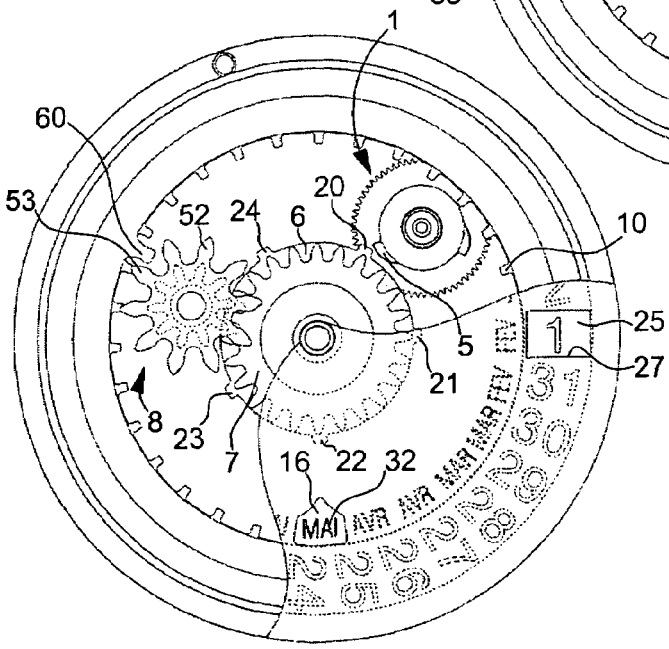
Figure 4:
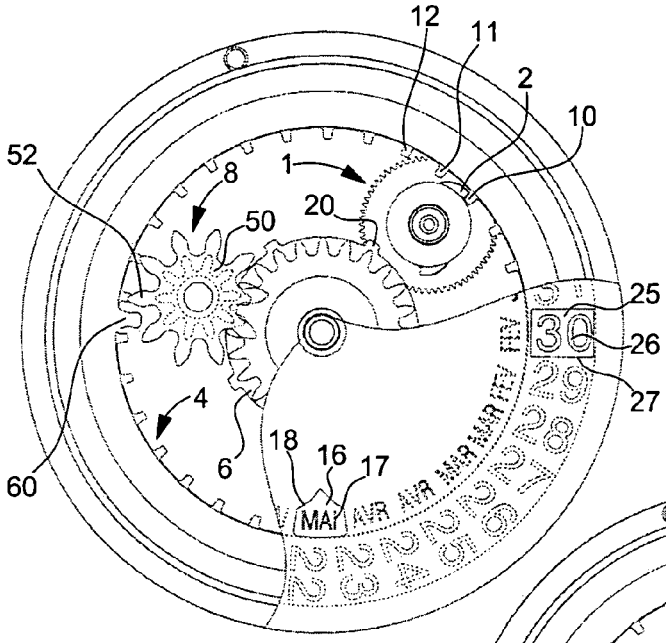
Figure 5:
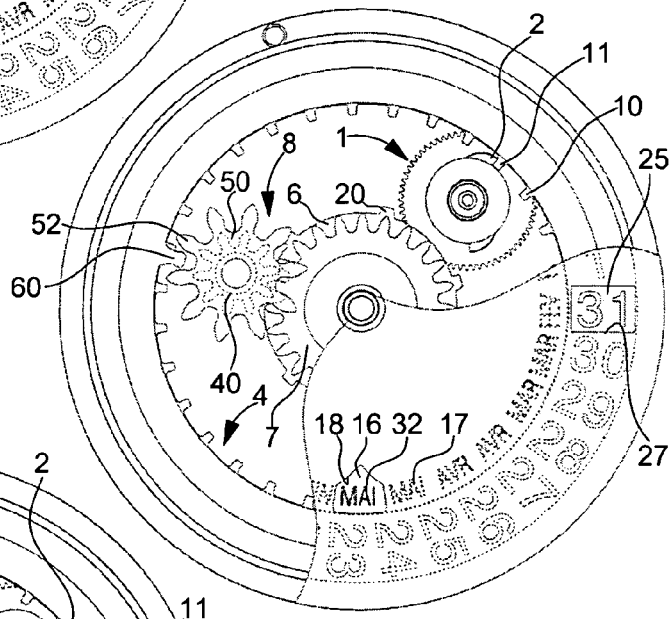
Figure 6:
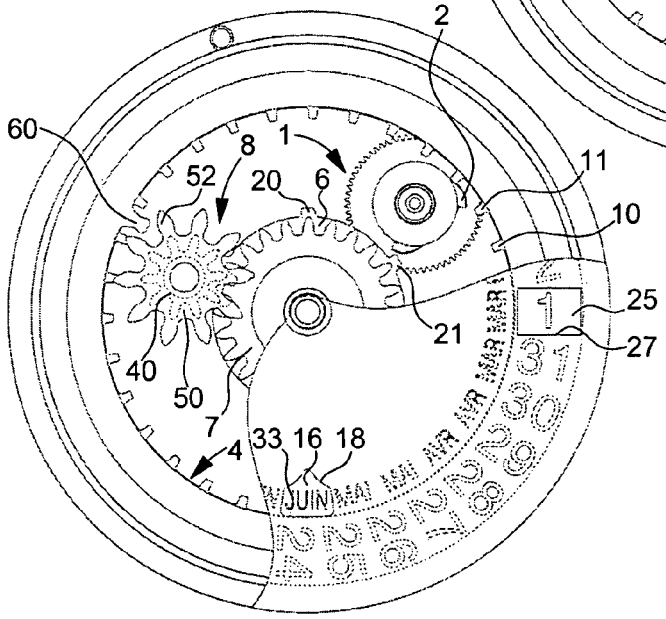
Figure 7:
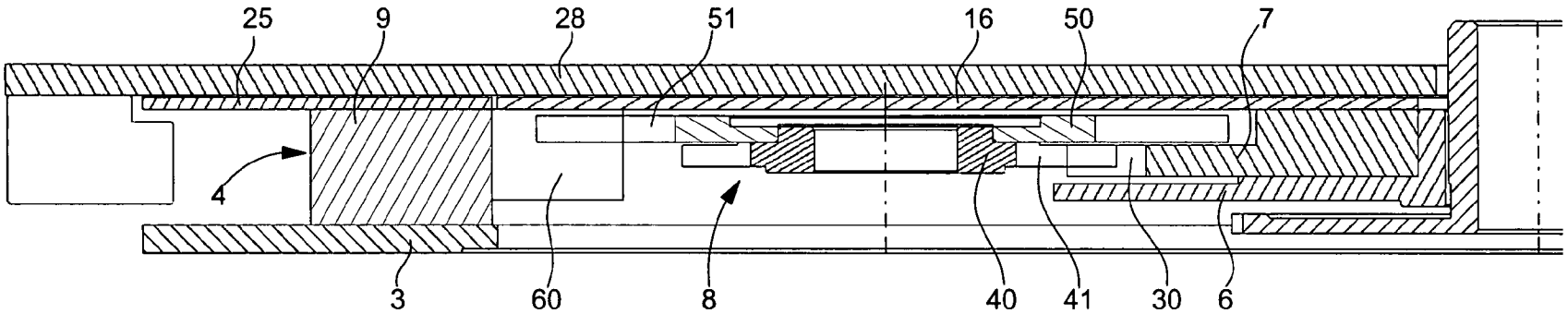
Figure 8:
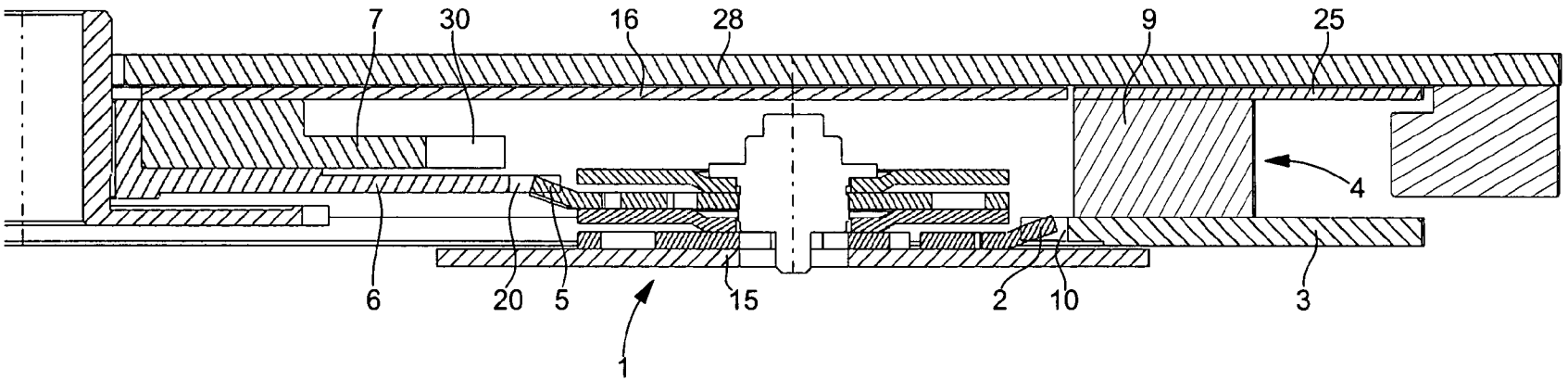
Figure 9:
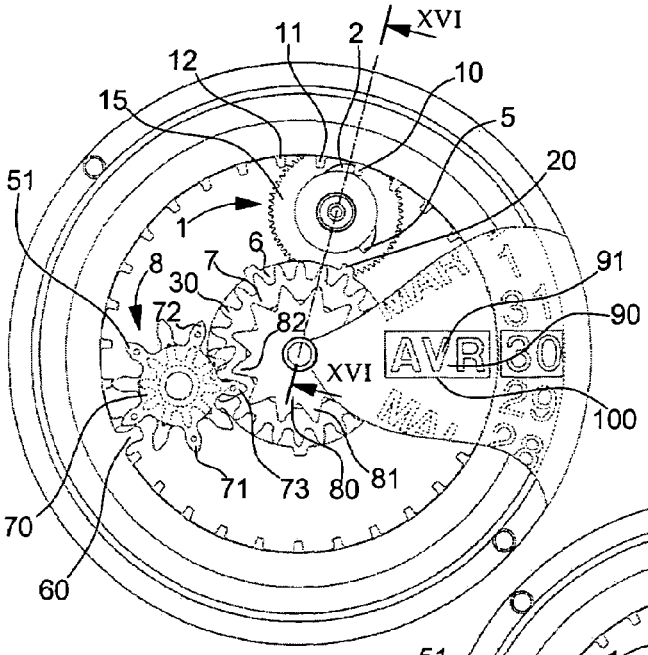
Figure 10:
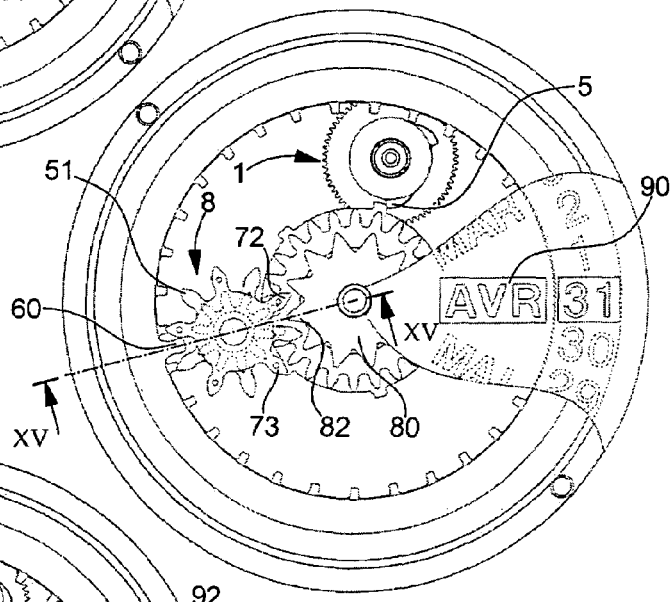
Figure 11:
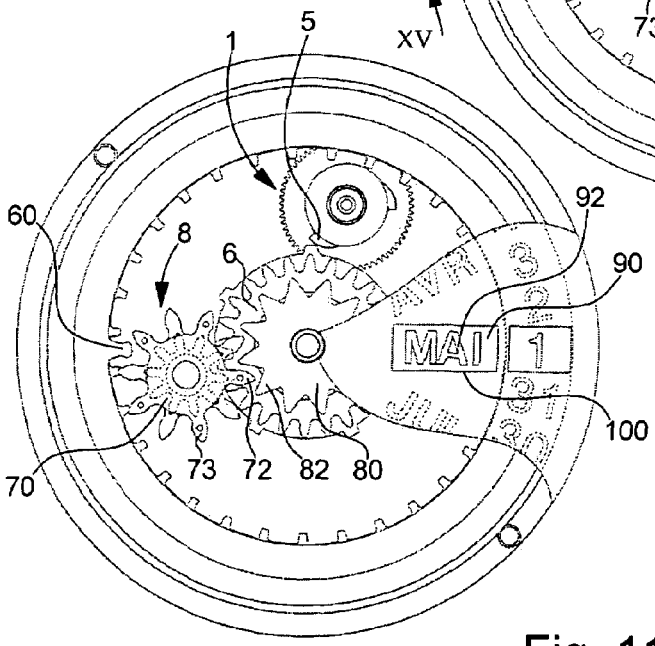
Figure 12:
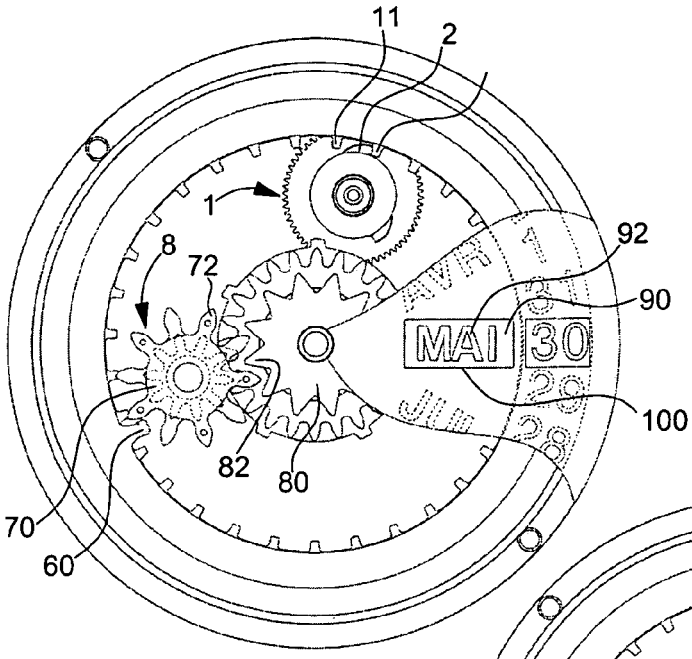
Figure 13:
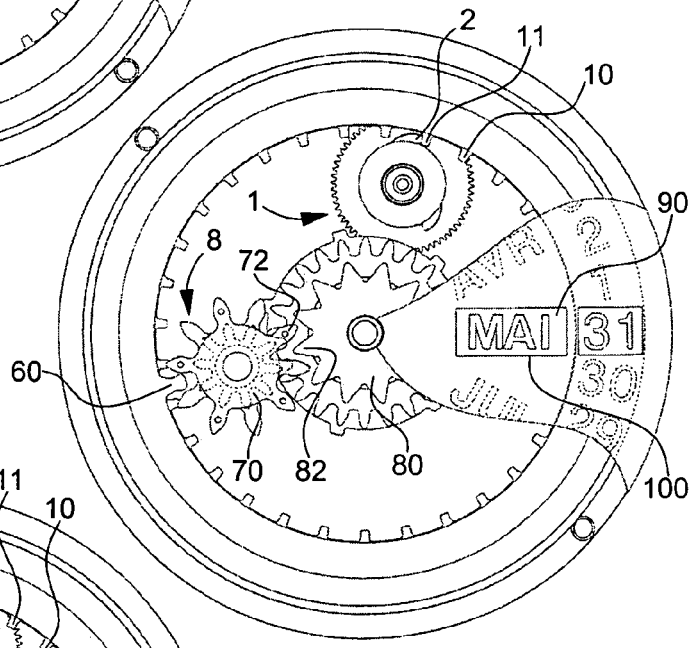
Figure 14:
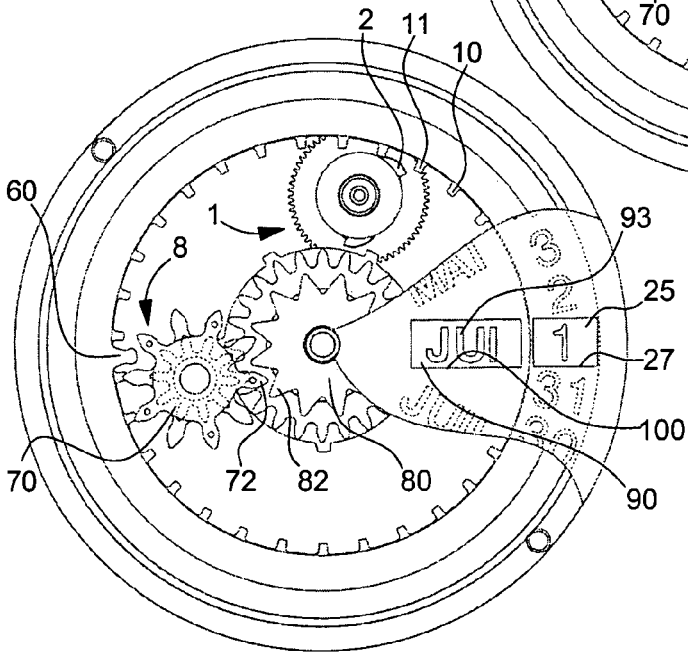
Figure 15:
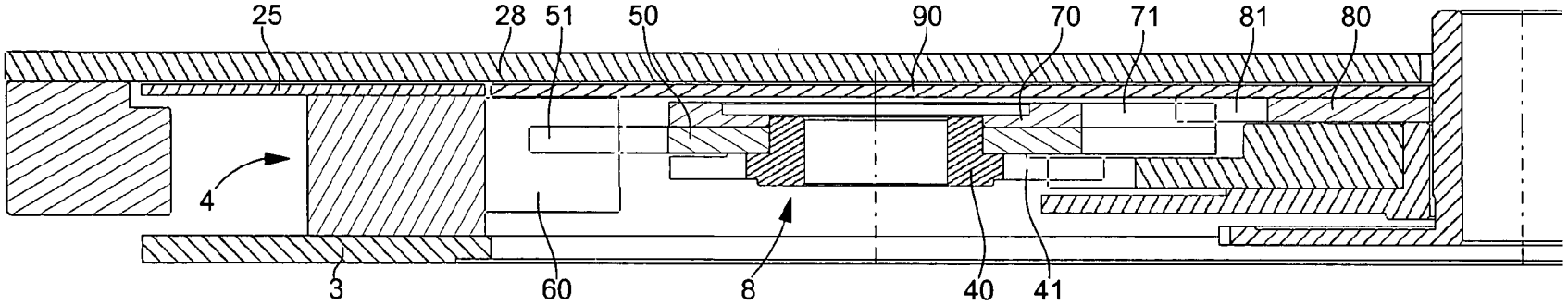
Figure 16:
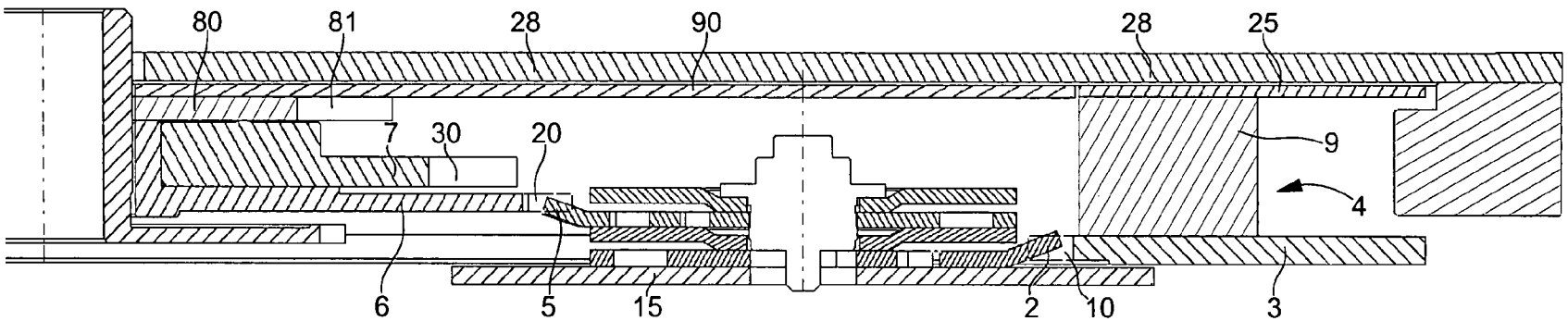

FIG. 3 illustrates the same mechanism as that shown in FIG. 1 on 1st May at 02:00, FIG. 4 is a plan view of the annual calendar mechanism as it appears on 30th May at 23:30 in accordance with the first embodiment of the invention, FIG. 5 illustrates the same mechanism as that shown in FIG. 4 on 31st May at 23:30, FIG. 6 illustrates the same mechanism as that shown in FIG. 4 on 1 June at 00:30, FIG. 7 is a cross-section along the line VII-VII of FIG. 2, FIG. 8 is a cross-section along the line VIII-VIII of FIG. 1, FIG. 9 is a plan view of the annual calendar mechanism as it appears on 30th April at 23:30 in accordance with a second embodiment of the invention, FIG. 10 illustrates the same mechanism as that shown in FIG. 9 on 1st May at 00:30, FIG. 11 illustrates the same mechanism as that shown in FIG. 9 on 1st May at 02:00, FIG. 12 is a plan view of the annual calendar mechanism as it appears on 30th May at 23:30 in accordance with the second embodiment of the invention, FIG. 13 illustrates the same mechanism as that shown in FIG. 12 on 31st May at 23:30, FIG. 14 illustrates the same mechanism as that shown in FIG. 12 on 1 June at 00:30, FIG. 15 is a cross-section along the line XV-XV of FIG. 10, and FIG. 16 is a cross-section along the line VI-VI of FIG. 9.

An annual calendar mechanism made in accordance with a first use of the invention will now be described with reference to FIGS. 1 to 8.

This mechanism comprises, in a known manner, a date drive wheel set 1 completing one revolution in twenty-four hours. This wheel set 1 draws the drive force acting thereon from a kinematic chain driven by the timepiece movement the first link of which is illustrated by wheel 15. Wheel set 1 is fitted with a first finger 2 which drives, through one step and once a day at midnight, a first stage 3 of a date ring 4 carrying thirty one inner teeth three of which bear the references 10, 11, 12. Wheel set 1 is also fitted with a second finger 5 which drives, through one step and at the end of each month comprising less than thirty-one days, a plate 6 via one of its five snugs projections 20 to 24 (see FIG. 3).

Plate 6 is secured to an annual wheel 7, the assembly 6, 7 being arranged coaxially to the date ring 4. The Figures show finally that the annual calendar mechanism also comprises an intermediate wheel 8 which, at the end of each month, connects annual wheel 7 to a second stage 9 of date ring 4.

The mechanism of the present invention differs from that which has been described hereinbefore in that it has two remarkable and original arrangements. First of all there is the annual ring 7 which comprises twice as many teeth 30 as there are months in a year. In other words, annual ring 7 comprises twenty-four teeth 30. Finally, there is intermediate wheel 8 which comprises a first wheel 40 meshed with annual wheel 7, teeth 30 of the latter meshing with the teeth 41 of first wheel 40. Intermediate wheel 8 further comprises a second wheel 50 secured onto and arranged coaxially to first wheel 40. This second wheel 50 is meshed, at the end of each month, with a snug 60 arranged inside the second stage 9 of date ring 4. The Figures show that snug 60 is driven by teeth 51 which comprises second wheel 50.

It will be noted here that the two wheels 40, 50 that form intermediate wheel 8 are provided with teeth 41, respectively 51, regularly distributed over the periphery of the corresponding wheels, which involves very conventional machining, unlike the machining implemented for the intermediate wheel of the aforecited Patent No. EP-A1 251 412. The same comment can be made as regards snug 60 arranged inside the second stage 9 of date ring 4, there being only one snug unlike the two snugs located on two different levels and necessary for the date mechanism of the aforecited document to work.

FIGS. 1 to 8 also show that the date ring 4 carries a date indicator ring 25 on which thirty-one figures 26 are affixed. These figures appear in turn through an aperture 27 cut into a dial 28 of the timepiece.

The same Figures also show that annual wheel 7 carries a month indicator disc 16 on which are affixed the names of the twelve months of the year 17. These names appear in turn twice each month through an aperture 18 cut into dial 28. It can be seen that the month indicator disc therefore comprises twenty-four equal sectors.

The operation of the annual calendar will now be described with reference to FIGS. 1 to 6 to explain the passage from one month to another, first of all for the months with less than thirty-one days, then for the months with thirty-one days.

FIGS. 1 to 3 illustrate the passage from one month to another for the months with less than thirty-one days. The passage from 30th April to 1st May is taken by way of example.

FIG. 1 shows the situation of the display on 30th April at 23:30. The first finger 2 of the date drive wheel set 1 enters into contact with the inner tooth 10 of first stage 3 of date ring 4. The date indicator ring 25 causes a FIG. 26 to appear through aperture 27, which is 30 (April). The month indicator disc 16 causes the name of the month of April to appear for a first time 17 through aperture 18. Snug 60 arranged inside the second stage 9 of date ring 4 is close to tooth 52 of wheel 50 included in intermediate wheel 8.

FIG. 2 shows the situation of the display on 1st May at 0030 hours. Driven by the first finger 2 of wheel set 1, date ring 4 and its tooth 10 have progressed through one step. Indicator ring 25 briefly shows the FIG. 31 through aperture 27. At the same time, snug 60 connected to date ring 4 has also progressed through one step driving wheel 50 via its tooth 52 in the clockwise direction. Wheel 40, secured to wheel 50 to form intermediate wheel 8, in turn drives annual wheel 7 in the anti-clockwise direction and consequently plate 6 and snug 20 which is connected thereto. At this moment and following the rotation of wheel set 1, second finger 5 thereof enters into contact with snug 20 of plate 6. During this operation, annual wheel 7 has progressed through one twenty-fourth of a revolution, as has the month indicator disc 16, which is connected thereto. The name of the month of April thus appears a second time 31, but very briefly, through aperture 18.

FIG. 3 shows the situation of the display on 1st May at 02:00. Continuing its rotation, wheel set 1 via its second finger 5 has driven plate 6 and its snug 20 in the anti-clockwise direction. Thus annual wheel 7, secured to plate 6, which was driven and now drives in its turn intermediate wheel 8 in the clockwise direction and its tooth 53 causes the date ring 25, via its tooth 60, to progress through one step. Indicator ring 25 shows the FIG. 1 through aperture 27. By rotating, annual wheel 7 has driven month indicator disc 16 which then displays the month of May for the first time 32.

It will be observed (see FIG. 3) that the five snugs 20, 21, 22, 23 and 24 each correspond to the months of less than thirty one days, namely the months of April, June, September, November and February. It is arranged that each of the snugs is located on the path of finger 5 of wheel set 1 at the end of the months that have just been cited. In order to do this, snugs 20 to 24 are necessarily placed around plate 6 at 60°, 90°, 60°, 90° and 60°. It will thus be observed that at the end of the month of February, a manual correction remains necessary. Finally, it will be noted that the date drive wheel set 1 can be of the semi-instantaneous passage type in which case a jumper spring (not shown) has to be arranged on the inner toothing of the date ring.

FIGS. 4 to 6 illustrate the passage from one month to another for the months with thirty-one days. Passage from 30th May to 1st June is taken by way of example.

FIG. 4 shows the situation of the display on 30th May at 23:30. Finger 2 of drive wheel set 1 enters into contact with the inner tooth 10 of date ring 4. The date indicator 25 causes a FIG. 26 to appear through aperture 27, which is 30 (May). The month indicator disc 16 cause the name of the month of May to appear for a first time through aperture 18. Snug 60 of date ring 4 is close to tooth 52 of wheel 50 which forms intermediate wheel 8. If the angular position of snug 20 of plate 6 is observed, it will be noted that the annual wheel has remained in the place it was on 1st May at 02:00 (see FIG. 3).

FIG. 5 shows the situation of the display on 31st May at 23:30. Driven by finger 2 of wheel set 1, date wheel 4 and its tooth 10 have progressed through one step. Date indicator ring 25 shows the FIG. 31 through aperture 27 and, at 23:30 on 31st May, finger 2 of wheel set 1 enters into contact with the inner tooth 11 of date ring 4. While passing from 30th to 31st May, snug 60 connected to the date ring has also progressed through one step driving wheel 50 via its tooth 52 in the clockwise direction. Wheel 40, secured to wheel 50 to form intermediate wheel 8 in turn drives annual wheel 7 in the anti-clockwise direction and consequently plate 6 and snug 20 which is connected thereto, in the same direction. During this operation, annual wheel 7 has progressed through one twenty-fourth of a revolution as has month indicator disc 16 which is connected thereto. The name of the month of May thus appears a second time 32, but briefly, through aperture 18.

FIG. 6 shows the situation of the display on 1st June at 00:30. By continuing its rotation wheel set 1, via its first finger 2, has driven date ring 4 through one step. The FIG. 1 of 1st June of date indicator 25 appears through aperture 27. At the same time, snug 60 of the date ring has driven wheel 50 in the clockwise direction via its tooth 52. Wheel 40 forming intermediate wheel 8 with wheel 50 drives annual wheel 7 through one step in the anti-clockwise direction. Month indicator disc 16, which is connected to the annual wheel, therefore also progresses through one step and causes the indication 33, namely June, to appear in aperture 18. It will be observed that plate 6 has also progressed through one step and therewith snug 21, this snug thus preparing itself to fulfil its function at the end of the month of June which only comprises thirty days.

An annual calendar mechanism made in accordance with a second embodiment of the invention will now be described with reference to FIGS. 9 to 16. This mechanism implements all of their elements used up until now and described hereinbefore to make the date mechanism in accordance with the first embodiment of the invention. Two additional elements have simply been added so that the name of the month appears only once in the aperture intended for such purpose.

Thus, FIGS. 9 to 16 show that intermediate wheel 8 comprises a third wheel 70 which is fixed onto second wheel 50, which, with first wheel 40, forms intermediate wheel 8. Moreover, a star wheel 80 is mounted on annual wheel 7 so as to rotate freely thereon. Star wheel 80 comprises branches 81 which mesh with teeth 71 of third wheel 70. The number of branches 81 and the number of teeth 71 that star wheel 80 and third wheel 70 respectively comprise, are arranged such that the star wheel progresses through one step when the third wheel progresses through two steps.

In corollary with the foregoing, star wheel 80 carries a month indicator disc 90 on which the names 91 of the twelve months of the year are affixed. These names appear once each month and in turn through an aperture 100 cut into a dial 28 of the timepiece. Indicator disc 90 thus comprises twelve equal sectors.

The operation of the annual calendar manufactured in accordance with the second embodiment of the invention will now be described to explain the passage from one month to another, without repeating all the details described with reference to the first embodiment but dwelling on the new elements and referring to FIGS. 9 to 16.

FIGS. 9 to 11 illustrate the passage from one month to another for the months with less than thirty-one days, the passage from 30th April to 1st May being taken by way of example.

FIG. 9 shows the situation of the display on 30th April at 23:30. The month of April 91 affixed to indicator disc 90 appears through aperture 100. Finger 2 of wheel set 1 is preparing to rotate the date ring and therewith snug 60 which will drive intermediate wheel 8 in the clockwise direction. The third wheel 70 of intermediate wheel 8 thus rotates in the clockwise direction. Teeth 71, 72 and 73 of wheel 70 are marked in the Figures by a small circle in order to identify them and distinguish them from teeth 51 of the second wheel which is located below the third wheel. The calendar displays 30.

FIG. 10 shows the situation of the display on $1^{st}$ May at 00:30. By rotating, the date ring displays very briefly the date of $31^{st}$. Its snug 60 has caused intermediate wheel 8 to rotate. On passing from the position shown in FIG. 9 to the position shown in FIG. 10, tooth 72 of third wheel 70 has not driven branch 82 of star wheel 80 and month disc 90 which is connected to said star wheel still displays the month of April.

FIG. 11 shows the situation of the display on $1^{st}$ May at 02:00. Intermediate wheel 8 driven by annual wheel 6 in turn driven by finger 5 of wheel set 1 makes the date wheel progress through one step via its snug 60. The first of May is displayed by the calendar. On rotating, the third wheel 70, via its tooth 72, causes star wheel 80 to progress through one step via its tooth 82. The month disc 90 connected to star wheel 80 also moves forward one step and the month of May 92 appears through aperture 100.

FIGS. 12 to 14 illustrate the passage from one month to another for the months with thirty-one days, passage from $30^{th}$ May to $1^{st}$ June being taken by way of example.

FIG. 12 shows the situation of the display on $30^{th}$ May at 23:30. The month of May 92 affixed to indicator disc 90 appears through aperture 100. Finger 2 of wheel set 1 is preparing to make the date ring rotation via its tooth 10. On rotating, the date ring, via its snug 60, will drive intermediate wheel 8 in the clockwise direction as well as third wheel 70 which is connected thereto. The calendar displays the date $30^{th}$.

FIG. 13 shows the situation of the display on $31^{st}$ May at 23:30. The date ring has moved forward through one step and the calendar displays the date $31^{st}$. Snug 60 of the date ring has made intermediate wheel 8 rotate. On passing from the position shown in FIG. 12 to the position shown in FIG. 13, tooth 72 of the third wheel 70 has not driven branch 82 of star wheel 80 and the month disc 90 which is connected to the star wheel still display the month of May.

FIG. 14 shows the situation of the display on $1^{st}$ June at 00:30. By continuing its rotation, wheel set 1, via its first finger 2 has driven the date ring through one step. The FIG. 1 of $1^{st}$ June of date indicator 25 appears through aperture 27. Snug 60 has thus progressed through one step driving intermediate wheel 8 in the clockwise direction. On rotating, third wheel 70 via its tooth 72, causes star wheel 80 to move forward one step via its tooth 82. Month disc 90 connected to star wheel 80 also moves forward one step and the month of June 93 appears through aperture 100.

The second embodiment of the invention, which has just been described, allows easier reading of the name of the month. In fact, month disc 90 only comprises twelve sectors, namely one sector per month which means that the name of the month can be considerably enlarged and its legibility increased. FIGS. 9 to 14 show this advantage clearly and especially the coordinated graphics of the date and month which have a similar size. It will be understood that this cannot be achieved if the month disc (FIGS. 1 to 6) comprises twenty-four sectors in which case the name of the month has to be decreased relative to the figures displaying the date.

It will also be mentioned that the annual calendar mechanism according to the invention is very simple to manufacture since it comprises only conventional regularly cut wheel, the teeth that they carry being distributed in a uniform manner over the periphery thereof. It will thus be noted that the mechanism in question can very easily replace a simple date mechanism comprising only the date without any signification alteration to the basic calibre. This is particularly the case of calibre 2892 A2 marketed by ETA SA Manufacture Horlogère Suisse.

What is claimed is:

1. An annual calendar mechanism for a timepiece comprising a date drive wheel set completing one revolution in twenty four hours, said wheel set being fitted with a first finger driving through one step and once a day a first stage of a date ring carrying thirty one inner teeth, said wheel set being fitted with a second finger driving through one step and at the end of each month of less than thirty one days one of the five projections of a plate secured to an annual wheel arranged coaxially to the date ring, said mechanism further comprising an intermediate wheel connecting, at the end of each month, said annual wheel to a second stage of said date ring, wherein the annual wheel comprises twice as many teeth as there are months in the year and wherein the intermediate wheel comprises a first wheel meshed with the annual wheel and a second wheel fixed onto and arranged coaxially to the first wheel, said second wheel being meshed, at the end of each month, with a snug arranged inside the second stage of the date ring.

2. A mechanism according to claim 1, wherein the date ring carries a date indicator ring onto which are affixed thirty one figures appearing in turn through an aperture cut into a dial of the timepiece.

3. The mechanism according to claim 1, wherein the annual wheel carries a month indicator disc onto which the names of the twelve months of the year are affixed, said names appearing twice each month in turn through an aperture cut into a dial of the timepiece, the indicator disc thus comprising twenty four equal sectors.

4. The mechanism according to claim 1, wherein the intermediate wheel comprises a third wheel fixed to the second wheel and wherein a star wheel is mounted on the annual wheel so as to rotate freely thereon, the branches of the star wheel being meshed with the teeth of the third wheel, the number of branches and the number of teeth that the star wheel and third wheel respectively comprise being arranged such that the star wheel progresses through one step when the third wheel progresses through two steps.

5. The mechanism according to claim 4, wherein the star wheel carries a month indicator disc on which there are affixed the names of the twelve months of the year, said names appearing each month once and in turn through an aperture cut into a dial of the timepiece, the indicator disc thus comprising twelve equal sector.

* * * * *